United States Patent [19]

Fisher-Votava

[11] Patent Number: 4,968,219

[45] Date of Patent: Nov. 6, 1990

[54] MULTI-STAGE COMPRESSOR WITH SEAL HEATING

[75] Inventor: Martha Fisher-Votava, Rockford, Ill.

[73] Assignee: Sundstrand Corporation, Rockford, Ill.

[21] Appl. No.: 369,986

[22] Filed: Jun. 22, 1989

[51] Int. Cl.[5] ..... F04B 49/02; F04B 39/04

[52] U.S. Cl. ..... 417/53; 417/243; 417/253; 417/266; 417/292

[58] Field of Search ..... 417/53, 243, 253, 254, 417/266, 270, 292, 426

[56] References Cited

U.S. PATENT DOCUMENTS

| | | | |
|---|---|---|---|
| 2,421,398 | 6/1947 | Waseige | 417/253 X |
| 2,650,018 | 8/1953 | Paget | 417/243 X |
| 3,190,545 | 6/1965 | Weber et al. | 417/266 |
| 4,077,743 | 3/1978 | Cochrane et al. | 417/53 |
| 4,121,839 | 10/1978 | Takano et al. | 277/3 |
| 4,334,833 | 6/1982 | Gozzi | 417/266 X |
| 4,345,880 | 8/1982 | Zanarini | 417/264 |
| 4,362,462 | 12/1982 | Blotenberg | 415/1 |
| 4,390,322 | 6/1983 | Buszich et al. | 417/243 |
| 4,574,590 | 3/1986 | Jones | 60/676 |
| 4,615,261 | 10/1986 | Meijer | 92/200 |

OTHER PUBLICATIONS

J. R. Ward, H. J. Skruch, W. G. Thelen, "Piston Seals for High Pressure Oil-Free Air Compressors", ASME paper No. 74-DGP-15, Jan. 28, 1974.

*Primary Examiner*—John Rivell
*Attorney, Agent, or Firm*—David H. Hitt

[57] ABSTRACT

A sleeve seal heating system for a multi-stage compressor is disclosed. The multi-stage compressor includes a mechanism for dissipating heat disposed between and in fluid communication with a pair of compressor stages in the multi-stage compressor. The present invention contemplates the inclusion of a mechanism for selectively bypassing the heat dissipating mechanism disposed between and in fluid communication with each pair of compressor stages to thereby warm a succeeding stage, causing the stage to become substantially operative. The mechanism for bypassing comprises a bypass valve. The bypass valve is controlled to bypass the mechanism for dissipating heat when a seal in the succeeding stage is not substantially operative. Each compressor stage comprises a piston reciprocating within a piston chamber, the piston chamber being in valved communication with and between a fluid input and a fluid output. Each piston has a seal about its periphery and between the piston and the piston chamber to thereby prevent fluid from leaking between the piston and the piston chamber. The seal must be heated in order to operate to prevent fluid from leaking between the piston and the piston chamber. Warm inlet air provides this heat.

22 Claims, 3 Drawing Sheets

MULTI-STAGE COMPRESSOR WITH SEAL HEATING

Technical Field

This invention relates to a seal heating system for a multi-stage compressor of the type used in an Onboard Inert Gas Generating System ("OBIGGS") which requires sealing of pistons in the compressor by means of heat in order to operate.

Background Art

Multi-stage compressors are not new. For years, it has been recognized that fluids may be compressed from a relatively low pressure to a relatively high pressure by compressing the fluid in stages, each stage providing an intermediate pressure resulting in less pressure differential across each stage. A common form of multi-stage compressor comprises a piston reciprocating within a piston cylinder. The piston is fitted about its periphery with a seal, typically in the form of a piston ring, which fits between the piston and the piston chamber to prevent fluid from leaking between the piston and the piston chamber. As operating pressures have increased over the years, there has been an ever-increasing demand for seal to remain effective at the higher pressures. Accordingly, much attention was directed to developing seals which could withstand high pressures without leaking.

Typical of prior art which has attempted to develop seals which would stand great pressure without leaking is U.S. Pat. No. 2,650,018 which issued to Paget on Aug. 25, 1953 and discloses a compressor having four cylinders in which fluid is compressed in four stages. The two lower pressure cylinders are supported by guide members which are connected to a crankcase, and reciprocable within these pressure cylinders are pistons which are connected by piston rods to crossheads slideably supported by the guide members. By reason of the connection of the piston rods to the crossheads, the movement of the piston rods is such that means may be provided for sealingly engaging the piston rods to prevent the passing of oil along them to the cylinders. Such sealing means is provided, and, in order to prevent oil passing the sealing means from gaining access to the pressure ends of the cylinders, means are provided for draining oil from the lower ends of the pressure cylinders. The two higher pressure cylinders are supported at the outer ends of the lower pressure cylinders and the pistons in the higher pressure cylinders are connected for reciprocation with the pistons in the lower pressure cylinders. With this arrangement, the only fluid escaping along the pistons and the high pressure cylinders will be the fluid that is present in the compressor cylinders. Paget does not show seals which must be heated to operate, nor does Paget disclose a seal heating system operable to warm seals until they are operable.

U.S. Pat. No. 4,390,322, which issued on June 28, 1983 to Budzich, is directed to a double acting multi-stage hydraulically driven gas compressor using a free floating piston including a hydraulic piston and a number of gas compressing pistons, those gas compressing pistons being sealed by high pressure oil supplied from the hydraulic drive stage. Budzich does not disclose the use of seals which require heating, nor does Budzich disclose a system for heating seals so that they may operate.

U.S. Pat. No. 4,121,839, which issued on Oct. 24, 1978 to Takano et al., is directed to a sealing system for use in a composite multi-stage pump or pumps which utilizes part of the liquid pressurized by the pump to moderate sealing conditions by introducing said liquid to a portion or portions around the shaft, where the sealing conditions are most critical, and by thus reducing the pressure imposed on the sealing portion make the designing of seals easy. Also, by introducing pressurized liquid of relatively low temperature to the critical portion(s), minimum flow rate is lowered and thus the operational range of the pump is extended. When two or more pumps are employed for maintaining continuous operation by alternately switching the working pumps, a flow passage is provided between the pumps so the pressurized liquid from the pump under operation can be introduced to the non-operating pump, thus utilizing the pressurized liquid to prevent liquid kept under pressure in non-operating pump from leaking therefrom. Therefore, Takano et al. does not address the problem of seals which require heating, nor does it address a system for heating seals.

U.S. Pat. No. 4,077,743, which issued on Mar. 7, 1978 to Cochrane et al., is directed to compression machinery including a low pressure stage, a high pressure stage and a single aftercooler, further including a bypass path through which fluid discharged from the low pressure stage is directed about the high pressure stage. The bypass path includes the aftercooler. Upon activation of the high pressure stage, a portion of the fluid through the bypass path is diverted to the suction side of the high pressure stage. As a result of continued operation of the high pressure stage, the flow of fluid through the bypass path is decreased and the flow of fluid through the high pressure stage is increased. Cochrane et al. is apparently directed to diverting fluid about a stage until it is operative and fails to teach a system for making a stage operative by heating a seal within the stage.

U.S. Pat. No. 4,362,462, which issued on Dec. 7, 1982 to Blotenberg, is directed to an improved method of cooling compressed gases intermediate successive compressive stages in a multi-stage intercooled compressor system without forming condensate. Cooling water flow to an intercooler intermediate successive compressive stages is regulated as a function of the actual temperature of the gas downstream of the intercooler and a set point temperature generated as a function of a linear approximation relating to the inlet dew point temperature and the pressure of the gases downstream of the intercooler. Apparently, Blotenberg is directed to a system for minimizing condensation within a multi-stage compressor. Therefore, Blotenberg is not directed to a seal heating system.

U.S. Pat. No. 3,190,545, which issued on June 22, 1965 to Weber et al., is directed to a multi-stage high pressure gas compressor in which sealing means are incorporated which comprises a casing containing a plurality of cylinders, valves, and pipe connections in the cylinder walls and a stepped piston with piston ring packings. Weber et al. discloses the provision of a piston seal consisting of U-rings in the final stage of the compressor, formed by a stationary U-ring packing located in the cylinder wall of the final stage, the space between the piston ring packing on the piston of the final stage and the first adjacent U-ring communicating through a non-return valve, cooling means and an oil trap with the suction pipe of the final stage and the space between the first and second U-ring communicating through a non-return valve, cooling means and an oil trap with a suction pipe of the penultimate stage. Therefore, Weber et al. is directed to a seal, and not a seal heating system as is the present invention.

U.S. Pat. No. 4,345,880, which issued on Aug. 24, 1982 to Zanarini, is directed to a multi-stage, reciprocating, positive displacement compressor, in which the various stages are coaxial one with the other. The compressor has a double acting, monorod, hydraulic jack and at least one piston guided to slide hermetically in a cylindrical chamber that is fixed to the support structure of the compressor; a cylindrical tubular liner that is fixed coaxially, at one extremity, to the aforementioned piston and points toward the jack. The cylindrical chamber is sealed, at the extremity pointing towards the jack, by a guide ring for the liner and, at the other extremity, by a disk. The piston and the cylindrical liner define in the cylindrical chamber the first and the second stage in the compressor. Third and fourth stages of the compressor are formed in a second cylindrical chamber coaxial with the first chamber and secured to the disk sealing the first chamber. Therefore, Zanarini is directed to a design for a multi-stage compressor and apparently is not directed to a seal heating system for a multi-stage compressor.

U.S Pat. No. 4,574,590, was issued on Mar. 11, 1986 to Jones, is directed to a method and apparatus for better sealing a piston to its cylinder, to effectively eliminate efficiency loss due to leakage of the high-temperature, high pressure driving gas around the edges of the piston. An elastomeric seal is located so as to seal the piston and cylinder combination at a minimum sufficient distance from the combustion chamber to prevent heat damage to the seal material by conduction of heat through the piston or cylinder material. Therefore, Jones is directed to a system for eliminating high temperatures which may occur in a compressor, rather than selectively heating seals within the compressor to provide operative seals for compression.

U.S. Pat. No. 4,615,261, which issued on Oct. 7, 1986 to Meijer, is directed to an improved piston ring assembly, particularly for a Stirling engine, comprising a piston ring made from a TFE flurocarbon such as Rulon which is disposed in a piston ring groove and is acted upon by an annular bi-metal element disposed between the groove and the ring. When the engine is cold, the bi-metal element urges the ring outwardly so that a flat radially outer surface of the ring is forced into face-to-face contact with the cylinder wall. When the engine has warmed up, the force of the element of the piston ring is relaxed and the thermal expansion of the piston ring maintains the outer surface of the ring in face-to-face contact with the cylinder wall Meijer is apparently directed to solution of a problem similar to that in the present invention. However, in order to effect his solution, Meijer employs a bi-metal device which works in conjunction with the sealing material to effect a seal. In the present invention, no bi-metal device is needed, as the seal is directly heated by warm inlet air supplied from a prior stage.

Disclosure of Invention

The prior art has completely failed to address the problem of heating sleeve seals in multi-stage compressors by supplying warm inlet air.

Accordingly, it is the primary object of this invention to provide a multi-stage compressor comprising a first compressor, a second compressor, means for dissipating heat disposed between and in fluid communication with the first and second compressors, and means for selectively bypassing the heat dissipating means disposed between and in fluid communication with the first and second compressors to thereby warm the second compressor, causing the second compressor to become substantially operative.

A further object to the invention is to provide a multi-stage compressor in which a means for bypassing comprises a bypass valve disposed between and in fluid communication with first and second compressors.

A still further object of the invention is to provide a multi-stage compressor wherein first and second compressors comprise a piston reciprocating within a piston chamber, the piston chamber being in valved communication with and between a fluid input and a fluid output.

Another object of the invention is to provide a multi-stage compressor wherein a piston has a seal about the periphery of the piston and between the piston and a piston chamber to thereby prevent fluid from leaking between the piston and the piston chamber.

A still further object of the invention is to provide a multi-stage compressor wherein a seal is heated to be operable to prevent fluid from leaking between a piston and a piston chamber.

Yet another object to the invention is to provide a multi-stage compressor wherein means for dissipating heat comprises a heat exchanger.

Still a further object of the invention is to provide a multi-stage compressor wherein a means for bypassing is controlled to bypass a means for dissipating heat when a seal is not substantially operative.

In accordance with the above objects, a preferred embodiment of the present invention is provided, being a multi-stage compressor comprising a plurality of pairs of compressor stages, each stage receiving fluid at a lower pressure and temperature and delivering the fluid at a higher pressure and temperature, a plurality of heat exchangers, each heat exchanger being associated with each pair of stages and receiving fluid at a higher pressure and temperature from a one of each pair of stages, cooling the fluid heated by compression in the one of each pair of stages and delivering the cooled fluid to another of each pair of stages, and a plurality of bypass valves, each bypass valve being associated with each Pair of stages and receiving fluid at a higher pressure and temperature from the one of each pair of stages, delivering the fluid heated by compression to the other of each pair of stages, bypassing the each heat exchanger to thereby warm the other of each pair of stages, causing the other of each pair of stages to become substantially operative.

Each stage comprises a piston reciprocating within a piston chamber, the piston chamber being in valved communication with and disposed between a low pressure fluid input and a high pressure fluid output. The piston has a seal about the periphery of the piston and between the piston and the piston chamber to thereby prevent fluid from leaking between the reciprocating piston and the Piston chamber. The seal is warmed to substantially operate, preventing fluid from leaking between the reciprocating piston and the piston chamber. The fluid may be a liquid or a gas. The bypass valves open when the seals are not substantially operative.

The present invention further contemplates providing a novel method for compressing fluid in a multi-stage compressor, comprising the steps of compressing a fluid in a first stage, cooling the compressed fluid only when a second stage is substantially operative to thereby activate the second stage by initially warming the second stage, and compressing the fluid in the second stage.

Laws of physics dictate that any compressible fluid, including a gas, experiences a temperature rise as it is compressed. Conversely, if a gas is initially in a compressed state and is thereafter decompressed, its temperature will drop. The present invention operates on this principle by using the heat which is naturally generated in compression occurring in each of the four stages as a source of heat to warm the seals in succeeding stages. By employing this method of warming the seals, the need for external sources of heat is eliminated, whereby improvements in efficiency and complexity are realized.

Other objects and advantages of the present invention will be apparent upon reference to the accompanying description when taken in conjunction with the following drawings:

Best Mode for Carrying Out Invention

In the preferred embodiment, the multi-stage compressor is used onboard an aircraft in an Onboard Inert Gas Generating System ("OBIGGS"). The OBIGGS system comprises a separator which takes atmospheric gases and separates them into elemental components. Since atmospheric air is approximately 78% nitrogen, the OBIGGS separator primarily produces a large amount of nitrogen, an inert gas. The nitrogen, having been separated from the atmospheric air by the separator, is delivered to a multi-stage compressor where it is compressed from an atmospheric pressure to a pressure of approximately 3,000 psia. This compression in the preferred embodiment takes Place in four intermediate stages. Should ambient atmospheric pressure change, the fourth compressor stage is controllable to assure that the output of the fourth stage remains at 3,000 psia. Following compression by the multi-stage compressor, the nitrogen is delivered to a small holding reservoir or tank where it is held until needed on the aircraft. Primarily, nitrogen is used onboard the aircraft to comprise the ullage in fuel tanks or to act otherwise as flame retardant in other parts of the aircraft.

Because nitrogen is used in the fuel tanks and other sensitive areas, it is of the greatest importance that the nitrogen be pure and uncontaminated. It is vital that the multi-stage compressor have effective seals to provide full compression and to prevent contamination from entering the cylinders. In the first and second stages, simple piston rings accomplish this purpose satisfactorily. However, in the third and fourth stages, where pressures are higher, use of a novel sleeve seal is required to perform this function effectively.

Figure 1:
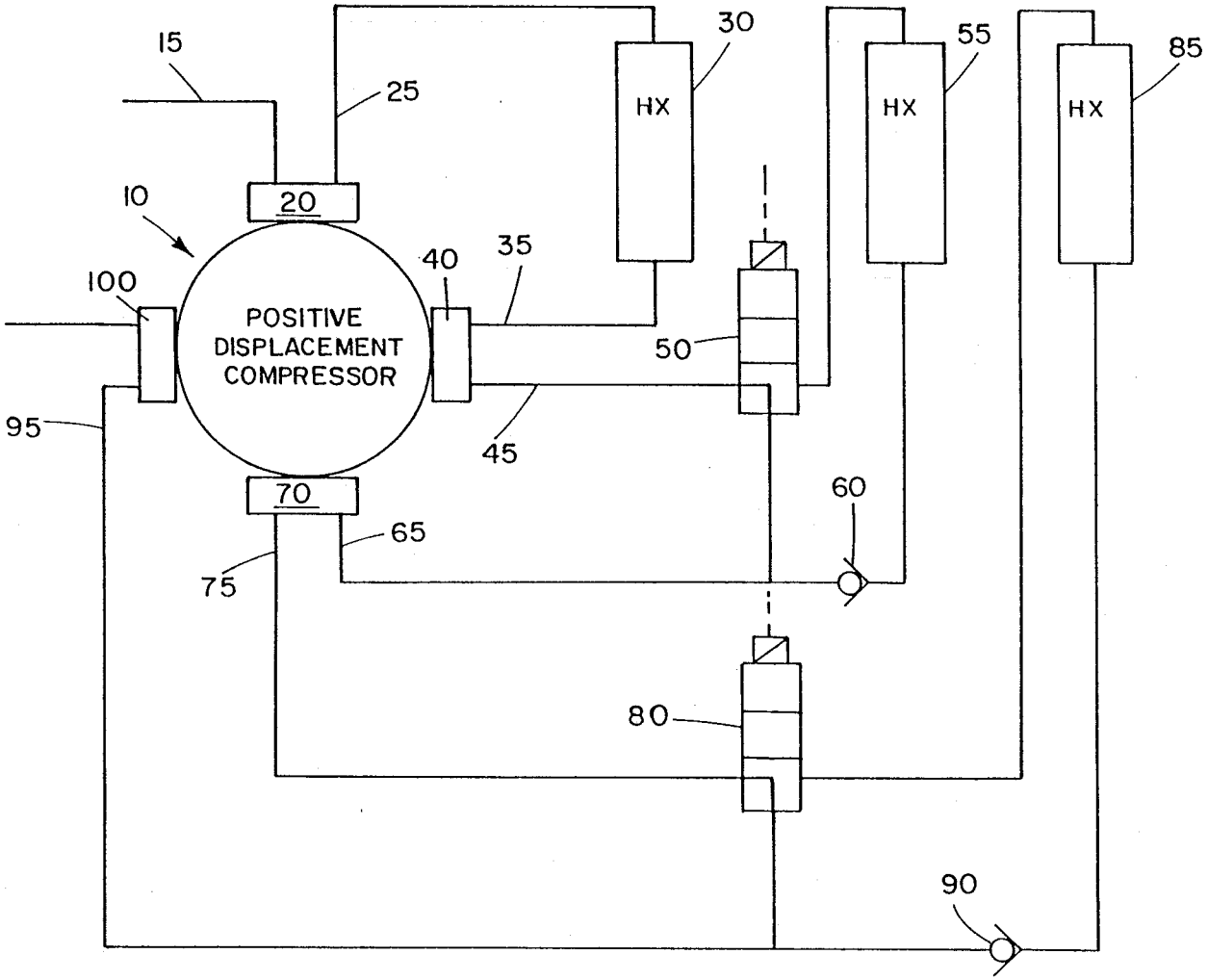
FIG. 1 in block diagram form illustrates the multi-stage compressor having seal heating.

Referring now to FIG. 1, which illustrates in block diagram form the invention in combination with its associated positive displacement compressor, shown in is a four stage positive displacement compressor 10.

Uncompressed gas enters through a first stage inlet pipe 15 into a first compressor stage 20, where it is partially compressed. Following compression, the partially compressed gas exits the first compressor stage 20 through a first stage outlet pipe 25. The gas, now warmed due to the compression that took place within the first stage, passes through a first heat exchanger 30 which, being in communication with a heat absorbing environment (not shown), cools the gas so that it may enter a second stage inlet pipe 35. The gas is compressed in a second compressor stage 40 and exits through a second stage outlet pipe 45.

Up to this point, the first and second stages have been of conventional construction. That is, pistons (not shown) within the stages have simple ring seals (akin to those found in automobile engines) which effectively seal regardless of their temperature. These ring seals are acceptable for the two lower pressure stages because the gas is not at an extremely high pressure. However, in the third and fourth compressor stages, gas is compressed to such a high pressure that ordinary ring seals become ineffective. Therefore, sleeve seals have been developed which effectively seal even at these higher pressures. The design and the use of these sleeve seals (which will be discussed later) are thoroughly described in a paper entitled "Piston Seals For High Pressure Oil-Free Air Compressors" published by J. R. Ward, H. J. Skruch and W. G. Thelen for the diesel and gas engine power division of the American Society Mechanical Engineers 74-DGP-15 and is incorporated herein in its entirety by reference.

In the preferred embodiment, these seals need to be heated in order to operate. Accordingly, the present invention provides for a first bypass valve 50 which opens under control of a controller (not shown) to bypass a second heat exchanger 55 until a third compressor stage 70 is operative. Once the third compressor stage 70 is operative, the first bypass valve 50 closes to route gas through the second heat exchanger 55 and a one-way valve 60 on its way to a third stage inlet pipe 65. The one-way valve 60 is provided so that when the first bypass valve 50 is opened to bypass the second heat exchanger 55, gas does not flow backwards from the third stage inlet pipe 65 to the second heat exchanger 55. If the first bypass valve 50 operates to bypass gas during startup of the compressor when the third stage 70 is inoperative, gas which has been heated by compression in the second compressor stage 40 enters through the third stage inlet pipe 65 into the third compressor stage 70, causing the third compressor stage 70 to warm and thereby causing the seal within the third compressor stage 70 to become operative. Gas compressed in the third compressor stage 70 exits through a third stage outlet pipe 75 and is controllably diverted around a third heat exchanger 85 by a second bypass valve 80 during compressor startup. Gas, which has now been warmed by compression in both the second compressor stage 40 and the third compressor stage 70 is caused to enter a fourth stage inlet pipe 95 and warms the fourth compressor stage 100, rendering it operative.

Sensors (not shown) in the third stage 70 and the fourth compressor stage 100 send signals representative of the operation of the third compressor stage 70 and the fourth compressor stage 100 to the controller (not shown). The controller (not shown) determines when the first bypass valve 50 and the second bypass valve 80 should operate to bypass the second heat exchanger 55 and/or the third heat exchanger 85, respectively. Finally, a one-way valve 90 is placed in line between the third heat exchanger 85 and the fourth stage inlet pipe 95 to prevent gas from flowing from the fourth stage inlet pipe 95 to the third heat exchanger 85 while the second bypass valve 80 diverts gas from the third heat exchanger 85.

In FIG. 1, the first, second and third heat exchangers 30, 55 and 85 are of conventional design and are well known to those ordinarily skilled in the art. The first and second bypass valves 50 and 80 are likewise well known to those ordinarily skilled in the art. Finally, one-way valves 60 and 90 are well known to those ordinarily skilled in the art.

Figure 2:
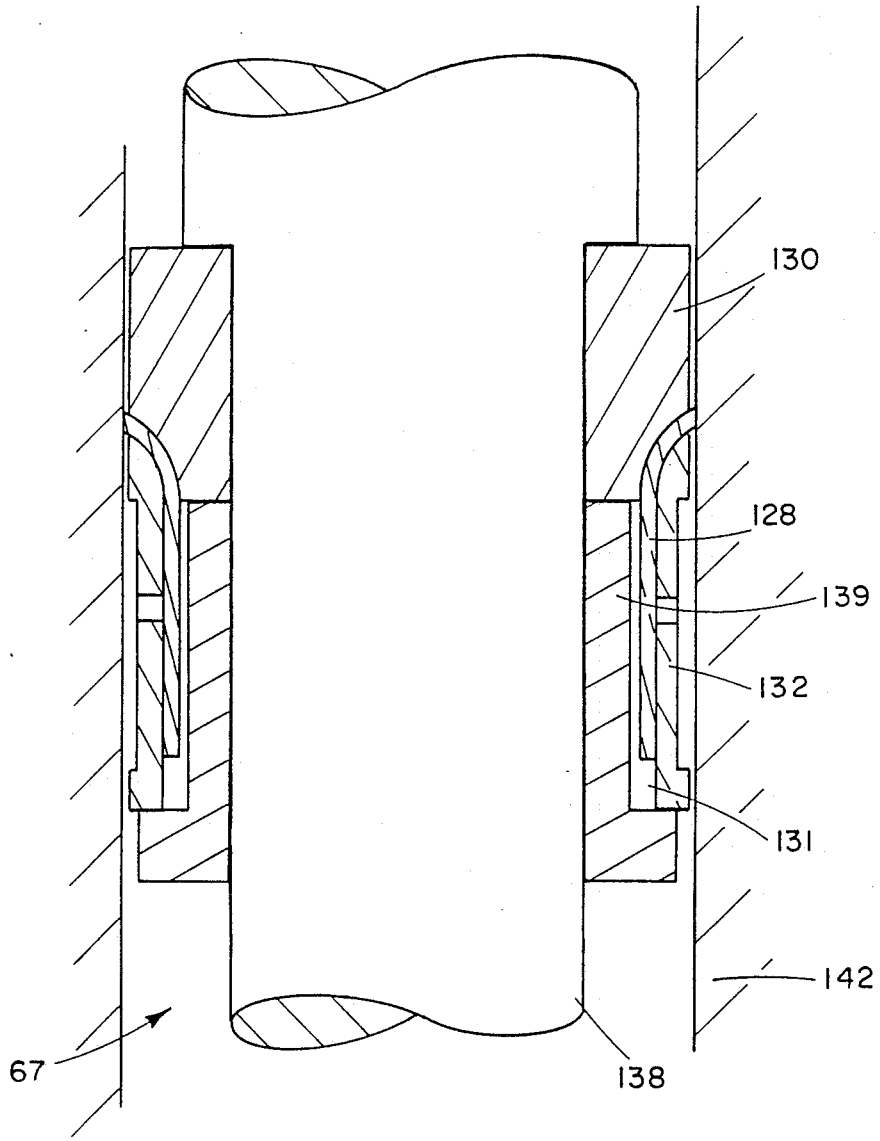
FIG. 2 is a partial section view of the sleeve seal requiring heating.

Referring now to FIG. 2, which shows a partial sectioned view of the sleeve seal to be heated, shown is a piston 138 reciprocating within a cylinder wall 142. A follower 130 and seal support 139 are annular and are fitted about the periphery of the piston 138. A sleeve seal 128 is also annular and fits around the follower 130 and the seal support 139. Finally, an annular outer sleeve 132 is fitted around the sleeve seal 128 to wedge the sleeve seal 128 between the follower 130, the seal support 139 and the outer sleeve 132.

As warm air enters into the chamber 67, the warm air begins to heat the follower 130 and the sleeve seal 128. The sleeve seal 128, which in the preferred embodiment, is made of polytetrafluorethylene ("PTFE") filled with metal fibers, expands and increases in formibility. A space 131 is provided for axial expansion of the seal. The seal is actuated by a combination of gas loading which forces the sleeve into the follower and then against the cylinder wall and radial thermal expansion of the seal lip. After the seal lip touches the cylinder wall, it will compressibly bear against the cylinder wall 142 to form a tight seal against pressures as great as 5000 psia.

Figure 3:
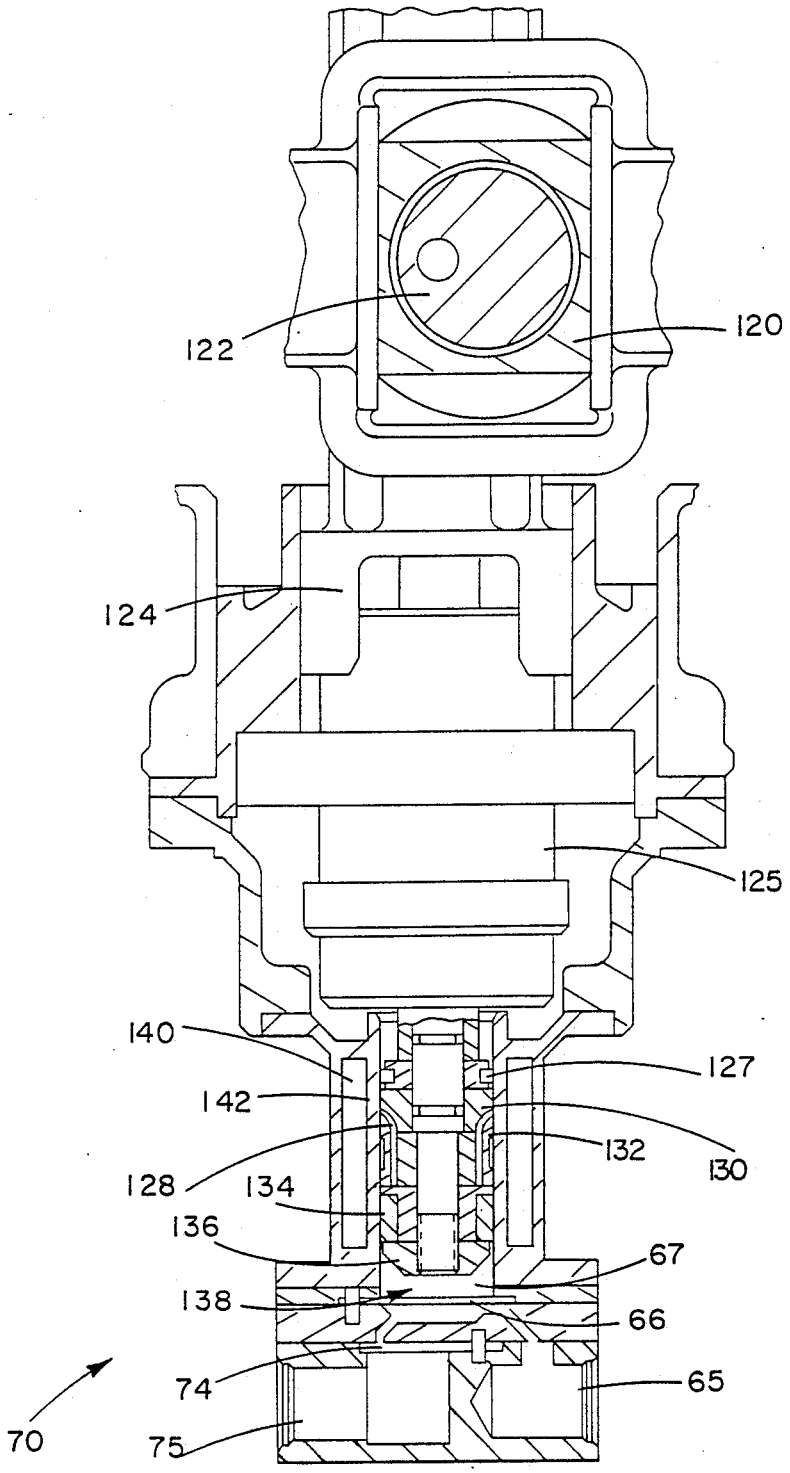
FIG. 3 is a partial section view of the multi-stage compressor showing the sleeve seal in place.

Referring now to FIG. 3, which shows a partial sectioned view of a representative four stage positive displacement compressor of the type with which the present invention may be used, operation of the compressor will be described.

A scotch yoke 120 forms the center of a four stage positive displacement pump. The scotch yoke 120 comprises a crankshaft 122 which rotates, causing a reciprocating action in a crosshead 124. The crosshead 124 causes reciprocation in a connecting rod 125 which causes, in turn, reciprocation of a piston 138.

The piston 138 is fitted about its periphery with a variety of seals. A starter ring seal 127 is used as a nominal sealer for fluids which may leak past a sleeve seal 128. The sleeve seal 128 is of primary focus in the third compressor stage 70. The sleeve seal 128 is made of PTFE which has been filled with metal fibers (copper, in the preferred embodiment). The sleeve seal 128 is annular and slides between a follower 130 and an outer sleeve 132. As the temperature of the sleeve seal 128 increases, it is compressibly urged against the cylinder wall 142 at which point sealing takes place. Due to the design of the sleeve seal 128, effective sealing can take place even if pressures in the third compressor stage 70 approach 5,000 psia. A retaining nut 136 is seated to urge against a rod guide 134 which holds the assembly comprising the sleeve seal 128, outer sleeve 132, and follower 130. During startup, warm gas enters the third stage inlet pipe 65, through an inlet valve 66 and into a chamber 67, where it is compressed. Following compression, the gas, now that it has been compressed even further, exits through a discharge valve 74 into the third stage outlet pipe 75.

When the sleeve seal 128 has seated completely and the third compressor stage 70 begins to compress, gas is cooled by closing the first bypass valve (not shown in FIG. 3, but shown in FIG. 1 as 50), thus routing the gas through the second heat exchanger (not shown) prior to entering the third stage inlet pipe 65. During this time, the multi-stage compressor provides for an oil cooling chamber 140 to surround the piston 138 to further cool the Piston.

The fourth compressor stage (not shown) is structurally and functionally identical to the third compressor stage 70.

In the preferred embodiment, the first stage accepts nitrogen at an atmospheric pressure of roughly 25 psia. The first stage delivers that nitrogen at a pressure between 75 to 100 psia. The second stage accepts nitrogen from the first stage at 75 to 100 psia and delivers it at 300 to 400 psia. The third stage accepts nitrogen at 300 to 400 psia and delivers it to the fourth stage at 1200 to 1600 psia. The fourth stage accepts this nitrogen and delivers it at 3,000 psia. In the preferred embodiment, the first, second and third heat exchangers are air heat exchangers.

Although this invention has been illustrated and described in connection with the particular embodiment illustrated, it will be apparent to those skilled in the art that various changes may be made therein without departing from the spirit of the invention as set forth in the appended claims.

I claim:

1. A multi-stage compressor, comprising:
a first compressor;
a second compressor;
means for dissipating heat disposed between and in fluid communication with said first and second compressors; and
means for selectively bypassing said heat dissipating means disposed between and in fluid communication with said first and second compressors to thereby warm said second compressor, causing a second compressor to become substantially operative.

2. The multi-stage compressor as recited in claim 1, wherein said means for bypassing comprises a bypass valve disposed between and in fluid communication with said first and second compressors.

3. The multi-stage compressor as recited in claim 2, wherein said first and second compressors each comprise a piston reciprocating within a piston chamber, said piston chamber being in valved communication with and between a fluid input and a fluid output.

4. The multi-stage compressor as recited in claim 3, wherein said piston has a seal about the periphery of said piston and between said piston and said piston chamber to thereby prevent fluid from leaking between said piston and said piston chamber.

5. The multi-stage compressor as recited in claim 4, wherein said seal to be operated is heated to prevent fluid from leaking between said piston and said piston chamber.

6. The multi-stage compressor as recited in claim 5, wherein said means for dissipating heat comprises a heat exchanger.

7. The multi-stage compressor as recited in claim 6, wherein said means for bypassing is controlled to bypass said means for dissipating heat when said seal is not substantially operative.

8. In a multi-stage compressor having a first compressor stage with a first low pressure fluid input and a first high pressure fluid output, a second compressor stage with a second low pressure fluid input and a second high pressure fluid output, and a fluid cooler connected between said first high pressure fluid output and said second low pressure fluid input wherein said first high pressure fluid output delivers warmed fluid to said fluid cooler, said fluid cooler cooling said warmed fluid and delivering said fluid, now cooled, to said second low pressure fluid input, a compressor heating system, comprising:

a controllable bypass valve connected between said first high pressure fluid output and said second low pressure fluid input to thereby bypass said fluid cooler whereby said second low pressure fluid input receives non-cooled fluid from said first high pressure fluid output when said bypass valve is open to thereby warm said second compressor stage, causing a seal in said second compressor stage to become substantially operative, thereby permitting said second compressor stage to compress said fluid.

9. The compressor heating system as recited in claim 8 wherein said first and second stages each comprise a piston reciprocating within a piston chamber, said piston chamber being in valved communication with and between said first and second low pressure fluid input and said first and second high pressure fluid output, respectively.

10. The multi-stage compressor seal heating system as recited in claim 9 wherein said piston has a seal about its periphery and between said piston and said piston chamber to thereby prevent fluid from leaking between said piston and said piston chamber.

11. The multi-stage compressor seal heating system as recited in claim 10 wherein said seal is substantially operative when warm, thereby preventing fluid from leaking between said piston and said piston chamber.

12. The multi-stage compressor seal heating system as recited in claim 11 herein said fluid cooler is a heat exchanger.

13. The multi-stage compressor seal heating system as recited in claim 12 wherein said fluid is a gas.

14. The multi-stage compressor seal heating system as recited in claim 13 wherein said bypass valve closes when said seal is substantially operative.

15. A multi-stage compressor, comprising:

a plurality of compressor stages, each stage receiving fluid at a lower pressure and temperature and delivering said fluid at a higher pressure and temperature;

a plurality of heat exchangers, each heat exchanger being associated with a pair of compressor stages and receiving fluid at a higher pressure and temperature from a one of said pair of stages, cooling said fluid heated by compression in said one stage and delivering said cooled fluid to another of said pair of stages; and a plurality of bypass valves, each bypass valve being associated with a pair of compressor stages and receiving fluid at a higher pressure and temperature from said one of said pair of stages, delivering said fluid heated by compression to said other of said pair of stages, bypassing said each heat exchanger to thereby warm said other of said pair of stages, causing said other of said pair of stages to become substantially operative.

16. The multi-stage compressor as recited in claim 15, wherein each stage comprises a piston reciprocating within a piston chamber, said piston chamber being in valved communication with and disposed between a low pressure fluid input and a high pressure fluid output.

17. The multi-stage compressor as recited in claim 16, wherein said piston has a seal about the periphery of said piston and between said piston and said piston chamber to thereby prevent fluid from leaking between said reciprocating piston and said piston chamber.

18. The multi-stage compressor as recited in claim 17, wherein said seal is warmed to substantially operate, preventing fluid from leaking between said reciprocating piston and said piston chamber.

19. The multi-stage compressor as recited in claim 18, wherein said fluid is a gas.

20. The multi-stage compressor as recited in claim 19, wherein said bypass valves open when said seals are not substantially operative.

21. A method for compressing fluid in a multi-stage compressor, comprising the steps of:

compressing a fluid in a first stage, said compressing causing said fluid to become warmed;

warming a seal in a second stage with said fluid said warming rendering said seal substantially operative;

cooling said compressed fluid only when said seal in said second stage is substantially operative; and compressing said fluid in said second stage.

22. A method for compressing fluid in a multi-stage compressor, comprising the steps of:

compressing a fluid in a first stage;

rendering operative a second stage by initially warming said second stage with said compressed fluid;

cooling said compressed fluid only when said second stage is substantially operative; and compressing said fluid in said second stage.

* * * * *